US009045884B1

(12) United States Patent
Harden

(10) Patent No.: US 9,045,884 B1
(45) Date of Patent: Jun. 2, 2015

(54) SYSTEM AND METHOD FOR CAPTURING FERROUS ITEMS FROM FOOD WASTE SYSTEMS

(76) Inventor: Rowland S. Harden, Parker, CO (US)

( * ) Notice: Subject to any disclaimer, the term of this patent is extended or adjusted under 35 U.S.C. 154(b) by 831 days.

(21) Appl. No.: 13/330,532

(22) Filed: Dec. 19, 2011

(51) Int. Cl.
*E03C 1/00* (2006.01)

(52) U.S. Cl.
CPC ..... *E03C 1/00* (2013.01)

(58) Field of Classification Search
CPC ..... E03C 1/26
USPC ..... 4/619–660
See application file for complete search history.

(56) References Cited

U.S. PATENT DOCUMENTS

| | | | | | |
|---|---|---|---|---|---|
| 1,331,018 | A | * | 2/1920 | Luthy | 429/143 |
| 2,902,700 | A | * | 9/1959 | Chambers | 4/629 |
| 3,149,066 | A | * | 9/1964 | Ross | 209/223.1 |
| 3,160,583 | A | * | 12/1964 | Stem | 209/223.1 |
| 3,174,714 | A | * | 3/1965 | Brndsby | 248/309.4 |
| 3,486,393 | A | * | 12/1969 | Maxwell | 74/89.42 |
| 3,662,425 | A | * | 5/1972 | Klein et al. | 15/245 |
| 3,809,239 | A | * | 5/1974 | Barrett et al. | 209/636 |
| 3,926,792 | A | * | 12/1975 | Buford | 209/636 |
| 4,279,744 | A | * | 7/1981 | Antonwitsch | 209/214 |
| 4,367,138 | A | * | 1/1983 | Kustas | 209/224 |
| 4,494,657 | A | * | 1/1985 | Oldenkamp | 209/636 |
| 4,706,818 | A | * | 11/1987 | Zutell et al. | 209/636 |
| 4,717,469 | A | * | 1/1988 | Pirc | 209/8 |
| 4,744,469 | A | * | 5/1988 | Swallert | 209/636 |
| 4,750,621 | A | * | 6/1988 | Akesson et al. | 209/539 |
| 4,754,882 | A | * | 7/1988 | Petitpierre | 209/636 |
| 4,782,970 | A | * | 11/1988 | Edwards | 209/636 |
| 5,945,899 | A | * | 8/1999 | Leupold | 335/210 |
| 6,000,643 | A | * | 12/1999 | Gelder | 241/37.5 |
| 6,129,213 | A | | 10/2000 | Edwards | |
| 6,352,160 | B1 | * | 3/2002 | Harden | 209/636 |

* cited by examiner

*Primary Examiner* — Lori Baker
(74) *Attorney, Agent, or Firm* — Ramon L. Pizarro; Edwin H. Crabtree

(57) ABSTRACT

A system and method for preventing the ingestion of ferrous items by food scrap grinding and disposal devices attached to drains on sinks. An example of a system includes a base that engages the sink drain inlet that leads to the disposal, and at least one positioning tab that extends from the base in order to retain the position of the base relative to the sink. A magnet is suspended from the frame over the base, so that placement of the base about the drain inlet results in the positioning of the magnet over the drain inlet, and so that ferrous items are drawn to the magnet as they are about to enter the drain inlet, and so that the magnet is free to move in response to contact with the flow food waste materials.

19 Claims, 4 Drawing Sheets

SYSTEM AND METHOD FOR CAPTURING FERROUS ITEMS FROM FOOD WASTE SYSTEMS

BACKGROUND OF THE INVENTION (a) Field of the Invention

This invention generally relates to a system and method for capturing ferrous objects that are being carried by a flow of material, such as a flow of food waste that is traveling through the intake of a food waste disposal, such as the type commonly used in cafeterias or restaurants and the like. More particularly, but not by way of limitation, to system that and method that uses static focused magnets to pull and retain ferrous items, such as silverware, at a location near the inlet of a waste-food grinding device.

(b) Discussion of Known Art

It is quite common to find a food waste grinder in sinks to help break up and dispose of the food waste through a kitchen's sewer system. A known problem associated with these devices is the accidental introduction of flatware, which is commonly primarily made of a ferrous material, into the device. Flatware that enters the device inevitably results in damage flatware, and may result in damage to the waste grinder as well. Examples of approaches at addressing the problem of accidental introduction of flatware into a sink are found in U.S. Pat. No. 6,626,297 to Dailey and U.S. Pat. No. 4,706,818 to Zutell et al, both of which are incorporated herein in their entirety by reference.

An important problem associated with known devices is that they are not easily added to an existing system. For example, the Dailey device needs to be installed around the inlet of the disposal device, below the sink, which may not present a problem for a new installation, but can be burdensome to install in existing systems. The approach disclosed in the Zutell et al patent may be inserted into the inlet a disposal system, but is likely to result in significant obstruction of the flow, due to the fact that it consists of fixed magnets that extend across the inlet.

Still another device that is used to catch ferrous flatware along a flow is disclosed in U.S. Pat. No. 4,279,744 Antonwitsch, which is also incorporated herein by reference in its entirety. The Antonwitsch device is based on the use of magnets mounted along an axle. The axle is supported by bearings at the ends of the axle. While the movement provided by the use of an axle disclosed by Antonwitsch is of interest, the arrangement of magnets along the axle greatly reduces the efficiency of the device, since it must be mounted at a significant distance from the flow of waste material. Since the strength of a magnetic field of a dipole magnet typically decreases in approximate proportion to the inverse square of the distance from the magnet, it is important to find a solution that places the magnets as close as possible to the flow of waste that may contain flatware. Increasing the distance by two places one at a location where the magnetic field is at one-quarter of its original strength. Accordingly, the Antonwitsch device suffers from the limitation that the support of the magnets results in an inefficient use of the magnetic field.

In my U.S. Pat. No. 6,352,160, incorporated herein by reference in its entirety, I disclose a system that mounts along a trough or similar flow containment device that carries food waste items, and which uses magnets to separate flatware from the flow.

Therefore, a review of known devices reveals that there remains a need for a system that can be used to remove flatware or other ferrous objects from a moving flow of material that is carrying the flatware.

Still further, there remains a need for a system that can be used to modify existing flow based waste carrying systems, without having to modify extensively the existing trough or arrangement used to wash the waste products towards a grinding or disposal system.

SUMMARY

It has been discovered that the problems left unanswered by known art can be solved by providing a support for holding a magnet over the entrance of a drain inlet that leads to a disposal that grinds waste food items being delivered into the drain or sink inlet of an institutional or commercial kitchen by a flow of food waste materials, and a preferred example of the invention includes:

- a base that is adapted for engaging the sink that is connected to the drain inlet that leads to the disposal;
- a frame extending from the base;
- at least on positioning tab that extends from the base in order to retain the position of the base relative to the sink, and a magnet that is suspended from the frame over the base, so that placement of the base about the drain inlet results in the positioning of the magnet over the drain inlet, and so that ferrous items are drawn to the magnet as they are about to enter the drain inlet, and so that the magnet is free to move in response to contact with the flow food waste materials.

According to a highly preferred embodiment of the invention, the base mounts about the inlet of the sink and the frame, which supports the magnet, is supported from the frame. However, it is contemplated that the base may be used to support the frame from the sink while supporting the magnet from the frame.

The positioning tabs are used to maintain the position of the base relative to the drain inlet. Thus, according to a preferred example of the invention a pair of positioning tabs are incorporated into the base by simply cutting the base from a single sheet of planar material, preferably stainless steel, and incorporating the tabs into the base as protrusions into the area that is to coincide with the drain inlet. The tabs are then bent in the same direction, away from the plane of the rest of the base. Then, the frame is attached to the base, on the opposite side of the sheet of planar material.

Preferably, the frame will include a loop that will accept a link, or looped section of rigid material, that will in-turn support the magnet from the frame in a manner that allows the magnet to swing from the frame. It is contemplated that the linked arrangement will allow the user to position the frame over the drain inlet to pivotally support the magnet from the frame. It is contemplated that a powerful magnet or magnet assembly is required to effectively capture silverware from the flow of waste food. Accordingly, in order to prevent problems associated with mounting the magnet from the frame after the frame has been inserted into drain inlet, it is contemplated that the disclosed invention will be supplied to the user with the magnet pivotally connected to the frame.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
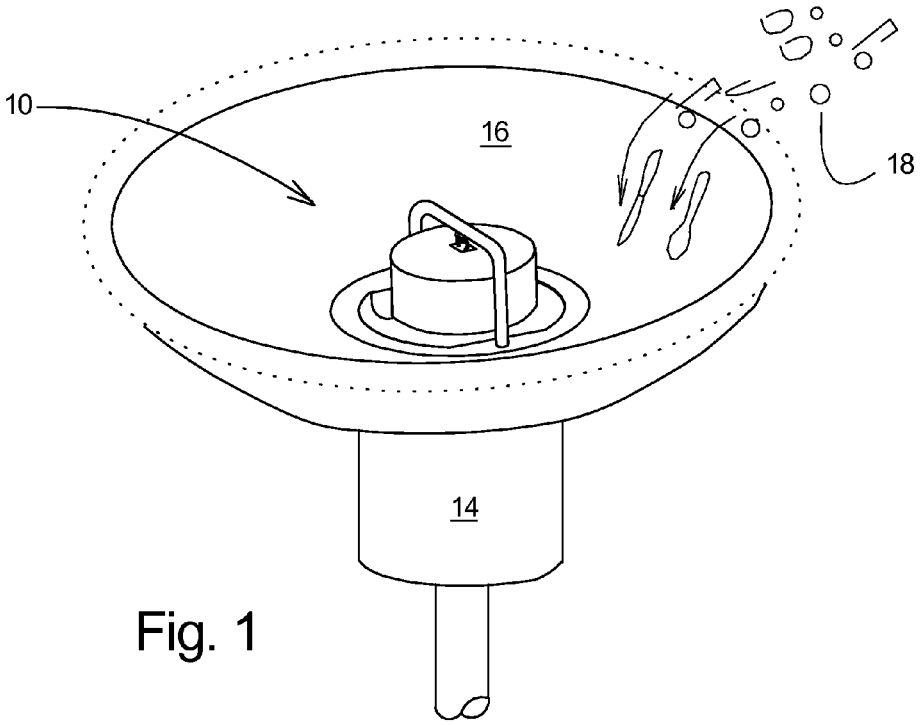
FIG. 1 is a perspective view of a highly preferred embodiment of the invention while in use.
Figure 2:
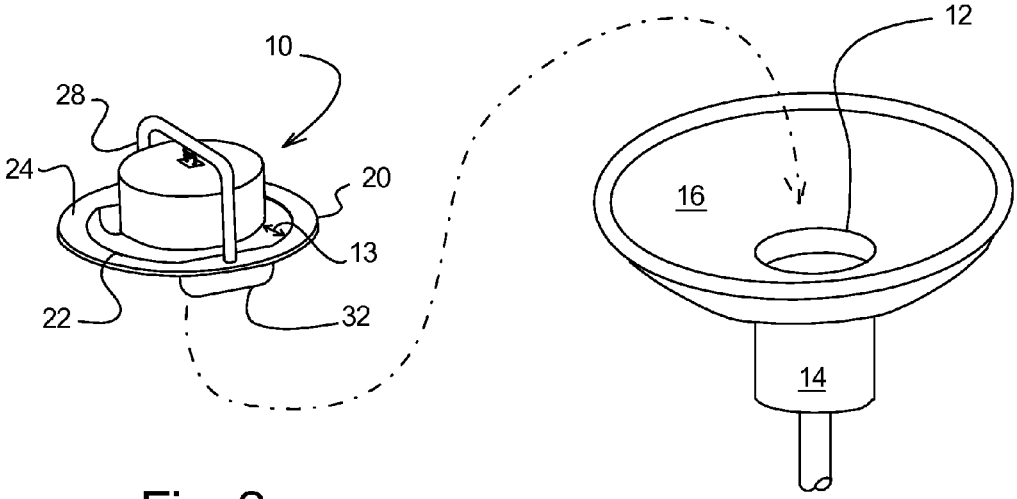
FIG. 2 is perspective view of a highly preferred embodiment of the disclosed invention prior to installation on the drain inlet.

Turning now to FIGS. 1 and 2 where a preferred embodiment of a device for preventing the ingestion of ferrous materials 10 made in accordance with the principles disclosed here has been illustrated. FIG. 1 illustrates that the disclosed invention will be mounted in a drain inlet 12, which provides a passage to a disposal device 14, which grinds food items contained in a flow of waste food material 18 prior to allowing the food items from entering the sewer system. It is important to note that it is contemplated that the disclosed invention would be used as part of institutional, restaurant or cafeteria dishwashing systems, where large numbers of plates and silverware are initially cleaned at a table or trough that can then be washed into a sink area 16. The washing of the items removed from the dishes is delivered as part of a flow 18 of water and waste food items, which carries the waste food into the sink area 16 where it is then diverted into the drain inlet 12. The drain inlet 12 allows the flow into the disposal device 14, as indicated above.

Figure 3:
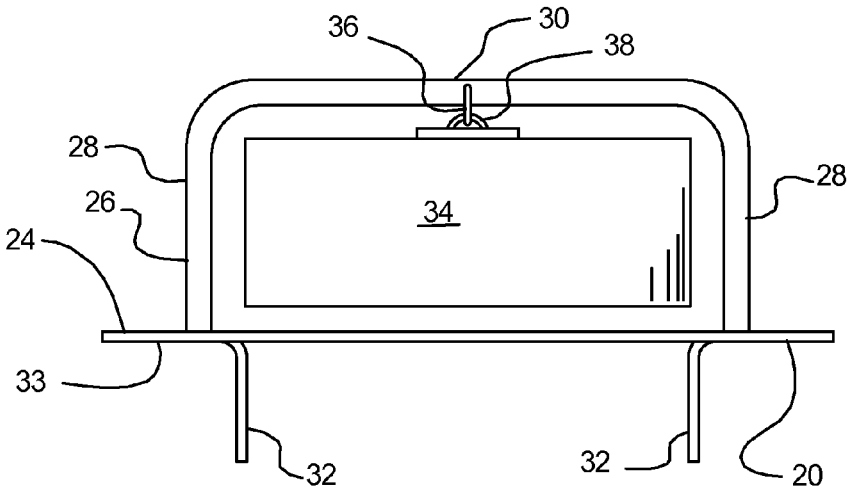
FIG. 3 is a side view of the disclosed invention, illustrating the preferred arrangement of the tabs, the base, the frame, and the magnet.
Figure 4:
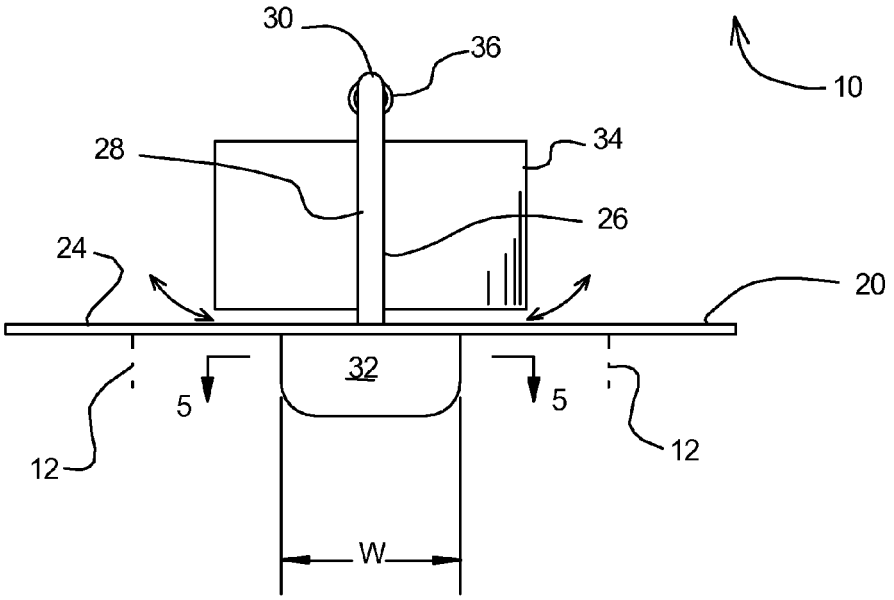
FIG. 4 is an end view of the disclosed invention and illustrates the swinging of the magnet.

Turning now to FIGS. 2-4, it will be understood that a highly preferred embodiment of the disclosed device for preventing the ingestion of ferrous materials 10 includes a base 20, which in a preferred embodiment is made from a single sheet of stainless steel. The base has been adapted for mounting at the drain inlet 12 and surrounding the drain inlet 12, and thus the base 20 includes an aperture 22 that allows the flow 18 to proceed through the base 20 and into the drain inlet 12.

Attached to the top surface 24 of the base 20 is a frame 26, which in a preferred embodiment is generally arch-shaped, and includes a pair of vertical supports 28 extending upwards from the base 20 in a direction away from the base. The arched-shaped frame 26 includes a horizontal portion 30 between the vertical supports 28. The frame 26 will be attached to the base 20 at a location on the base that will position the horizontal portion 30 over the aperture 22 through the base 20.

The preferred embodiment of the base 20 includes a pair of positioning tabs 32 that extend from the base 20. The positioning tabs 32 are preferably of integral, one-piece construction, with the base. The positioning tabs 32 are provided to ensure that the base 20 will be installed at the appropriate position on the drain inlet 12, such that the base 20 will not restrict flow into the drain inlet 12. Each of the positioning tabs extends from the base 20 in a direction opposite to the direction of extension of the frame 26. Thus on a planar base, such as the preferred example, the positioning tabs 32 will project down from the lower surface 33 of the base 20. Accordingly, as shown on FIG. 4, the base 20 will be positioned between the frame 26 and the positioning tabs 32.

Figure 5:
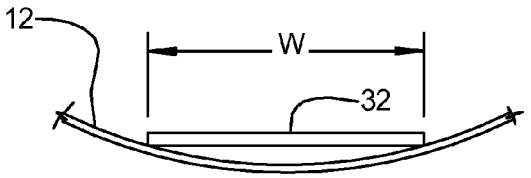
FIG. 5 illustrates the nesting of the tabs against the sides of a generally rounded drain inlet.

Turning to FIGS. 4 and 5 it will be understood that it is preferred that the width "W" of the tabs will be such that they will extend along a chord of the radius of the drain inlet 12 when the device for preventing the ingestion of ferrous materials 10 is inserted into the drain inlet 12. In other words, it is contemplated that the width "W" will be such that the device for preventing the ingestion of ferrous materials 10 will be nest securely within the drain inlet 12. Thus the disclosed tabbed approach obviates problems encountered when cylindrical devices, such as the cylindrical sleeve identified by reference character 13A in FIG. 3 of my U.S. Pat. No. 6,352,160. It has been found that cylindrical sleeves are often bent out of round by the common removal and handling the device in institutional or large volume dishwashing facilities. The deforming of such devices makes it very difficult to reinsert them into the drain inlet, which often results in replacement of the device.

FIGS. 3-4 also illustrate that the disclosed invention will support a generally planar magnet 34 while suspended from the frame 26 over the drain inlet 12. Thus insertion of the disclosed invention into the drain inlet 12 results in the positioning of the magnet 34 over the drain inlet 12, creating a gap 13 between the magnet 34 and the drain inlet 12, such that the flow of water and food waste items will close to the magnet 34 without facing detrimental flow restriction from the magnet 34. Additionally, as can be understood from FIGS. 3-4 when the flow of waste food material approaches the drain inlet 12, the flow will come very close to the magnet 34, and may even come into contact with the magnet 34. Accordingly, it is contemplated that the magnet 34 will be suspended through a connection 36 that allows the magnet 34 to pivot and swing from the frame 26, so that the magnet will move away from the flow of waste food material 18 and not obstruct the flow. Additionally, the suspension of the magnet in close proximity to the flow of waste food material 18 will position the magnet such that the flow will be in close proximity to the strongest region of magnetic flux from the magnet 34. The positioning of the magnet 34 at such close proximity to the flow will facilitate the capture of silverware or other ferrous materials that have been dropped into the flow of waste food material 18 before they are allowed to enter the drain inlet 12.

It is also important to note that while FIGS. 3 and 4 show that the magnet 34 is pivotally suspended from the frame 26 by a link 38 or links that are used as the connection between the frame and the magnet 34, it is contemplated that various types of pivoting or flexible connections may be used. For example, a hook or that cooperates with a semi-circular link and is attached to the magnet may also be used, or a flexible support such as stainless wire rope with a hook may also be used.

Figure 6:
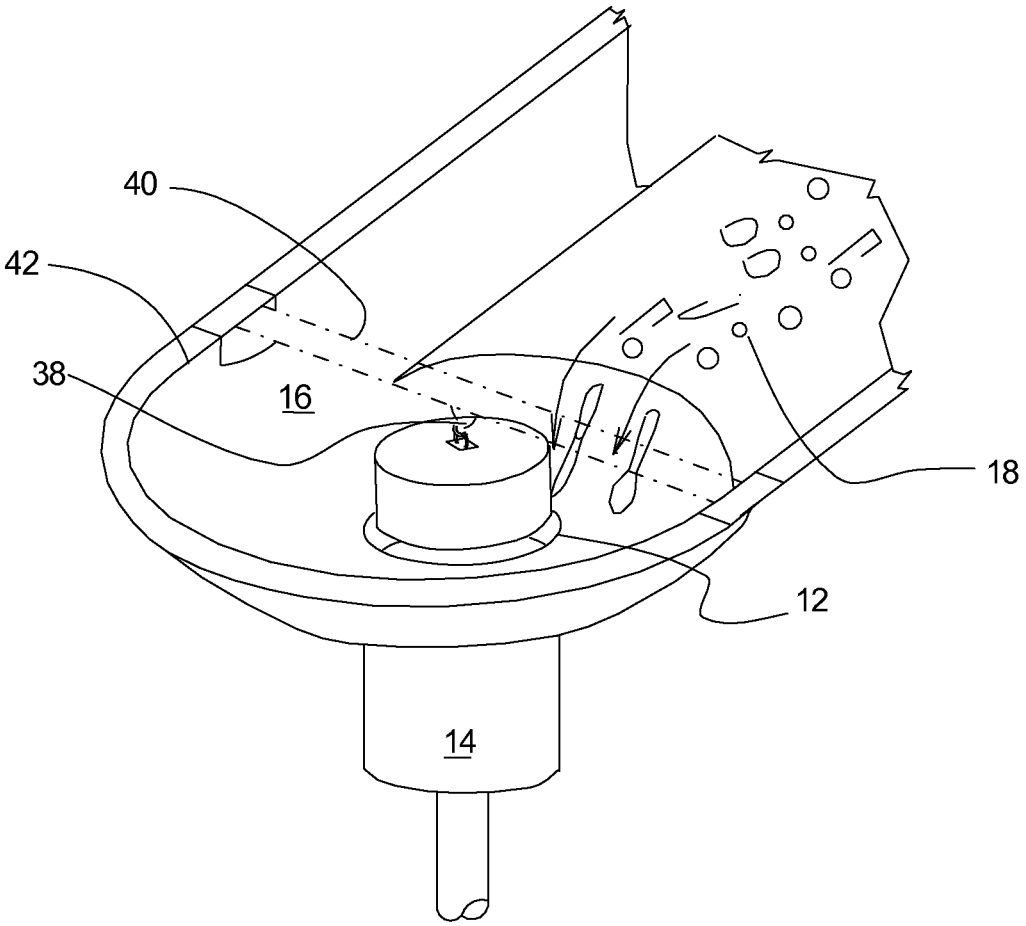
FIG. 6 illustrates an alternative device that would be used to support a magnet over the entrance of a drain inlet.

FIG. 6 illustrates another approach at supporting a magnet in close proximity to the drain inlet 12. In this embodiment the magnet is supported from a bridging portion 40 that is supported from the edge 42 of the sink area 16. The embodiment of FIG. 6, however, is not likely to be useful for installations where the sink area 16 lies within a generally flat area near the entrance of a dishwasher.

Figure 7:
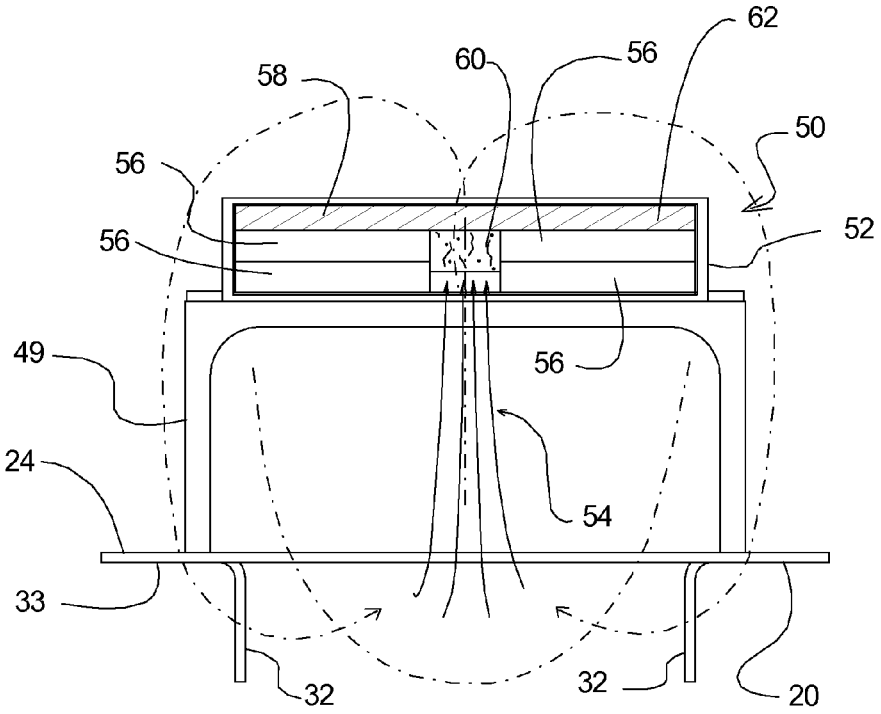
FIG. 7 illustrates yet another approach at using a toroidal magnet over the entrance of the drain inlet.
Figure 8:
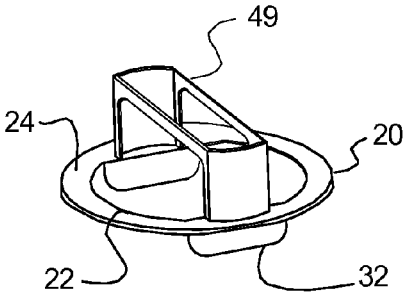
FIG. 8 illustrates the elevated frame used with the embodiment illustrated in FIG. 7.
Figure 9:
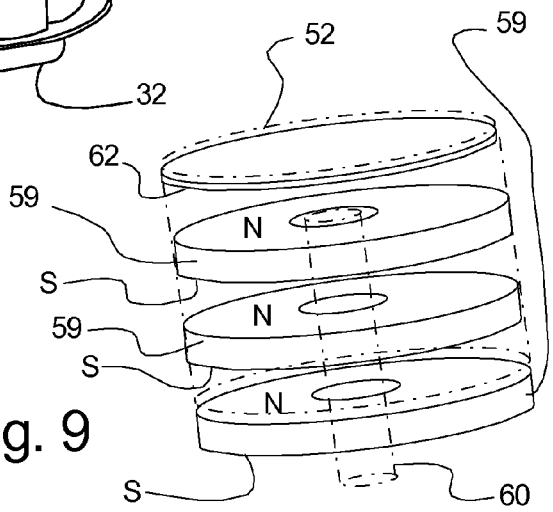
FIG. 9 illustrates the stack of toroidal permanent magnets in an exploded manner, the magnets being adapted for being encased within a stainless steel container, and the use of a ferrous core and an upper ferrous plate to focus, or direct, the magnetic field.

Turning now to FIGS. 7 and 8, it will be understood that by adding an elevation frame 49, one may support a magnet assembly 50 that is held within an enclosure 52. The enclosure 52 would then be mounted on the elevation frame 49 in a manner that would result in the magnetic flux 54 to be concentrated or projected into the drain inlet 12. As illustrated in FIG. 9, the concentration of the magnetic flux 54 is accomplished by using an assembly of stacked magnets 56 and a ferrous plate 58 that is used to guide the magnetic flux 54 in a desired area, which in this application is the drain inlet 12. The guiding and concentration of magnetic fields using a ferrous conductor is well-known, see for example U.S. Pat. No. 3,174,714, incorporated herein by reference in its entirety, and U.S. Pat. No. 5,945,899, incorporated herein by reference in its entirety. Accordingly, it is contemplated that known techniques will be used for concentrating the magnetic flux provided by the magnetic components of the disclosed invention. According to the preferred embodiment of the invention a ferrous core 60 and an upper ferrous plate 62 are used to focus, or direct, the magnetic field.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A device for removing ferrous materials from a flow of non-ferrous materials as the flow enters a drain inlet, the device comprising:

a base, the base extending along a base plane;

a frame extending from the base in a direction away from the base plane;

a positioning tab, the positioning tab extending from the base in a direction opposite to the direction of extension of the frame; and a magnet that is suspended from the frame over the base, so that placement of the base against the food waste system so that the aperture through the base extends about the drain inlet while the positioning tabs extend into the drain inlet results in the positioning of the magnet over the drain inlet, and so that ferrous items are drawn to the magnet before the ferrous items enter the drain inlet.

2. A device according to claim 1 wherein said magnet is pivotally suspended from the frame through a first semi-circular link attached to the frame and a second semi-circular link that engages the first semi-circular link and is attached to the magnet.

3. A device according to claim 1 wherein said positioning tab is of integral, one-piece construction, with the base.

4. A device according to claim 3 wherein said base and said positioning tab are made from a single sheet of material.

5. A device according to claim 4 wherein said frame is generally arched.

6. A device according to claim 5 wherein said magnet is generally planar, so that the magnet may be pushed aside by the flow.

7. A device for preventing the ingestion of ferrous materials and removing the ferrous materials from a flow of non-ferrous materials as the flow enters a drain inlet of a food waste system, the device comprising:

a base having an aperture through the base;

a generally arch-shaped frame having a pair of vertical supports extending from the base in a direction away from the base, arched-shaped frame having a horizontal portion between the vertical supports, the attached to the base such that the horizontal portion is positioned over the aperture through the base;

a pair of positioning tabs, each of the positioning tabs extending from the base in a direction opposite to the direction of extension of the frame, with the base being positioned between the frame and the positioning tabs; and a magnet that is suspended from the frame over the base, so that placement of the base against the food waste system so that the aperture through the base extends about the drain inlet while the positioning tabs extend into the drain inlet results in the positioning of the magnet over the drain inlet, and so that ferrous items are drawn to the magnet as they are about to enter the aperture through the base.

8. A device according to claim 7 wherein said magnet is pivotally suspended from the frame by a link that is attached to the magnet.

9. A device according to claim 7 wherein said magnet is pivotally suspended from the frame through a first semi-circular link attached to the frame and a second semi-circular link that engages the first semi-circular link and is attached to the magnet.

10. A device according to claim 9 wherein said pair of positioning tabs are of integral, one-piece construction, with the base.

11. A device according to claim 9 wherein said base and said positioning tabs are made from a single sheet of material.

12. A device according to claim 9 wherein said frame is centered over the tabs.

13. A device according to claim 12 wherein said magnet is generally planar, so that the magnet may be pushed aside by the flow.

14. A device for removing ferrous materials from a flow of non-ferrous materials as the flow enters a drain inlet, the device comprising:

a base, the base extending along a base plane;

a frame extending from the base in a direction away from the base plane;

a pair of positioning tabs, the positioning tab extending from the base; and a magnet that is suspended from the frame at a location between the base and the frame, so that placement of the base against the food waste system so that the aperture through the base extends about the drain inlet while the positioning tabs extend into the drain inlet results in the positioning of the magnet over the drain inlet, and so that ferrous items are drawn to the magnet as they are bout to enter the drain inlet.

15. A device according to claim 14 wherein said magnet is pivotally suspended from the frame through a first semi-circular link attached to the frame and a second semi-circular link that engages the first semi-circular link and is attached to the magnet.

16. A device according to claim 14 wherein said positioning tabs are of integral, one-piece construction, with the base.

17. A device according to claim 16 wherein said base and said positioning tab are made from a single sheet of material.

18. A device according to claim 17 wherein said frame is generally arched.

19. A device according to claim 14 wherein said magnet is generally planar, so that the magnet may be pushed aside by the flow.

* * * * *